US006339372B1

(12) United States Patent
Warnock et al.

(10) Patent No.: US 6,339,372 B1
(45) Date of Patent: Jan. 15, 2002

(54) PROTECTIVE SYSTEM FOR WORK IN RADIOACTIVE ENVIRONMENTS

(75) Inventors: Richard Warnock, Dana Point; Robert Corbett, San Clemente, both of CA (US)

(73) Assignee: Southern California Edison, Rosemead, CA (US)

( * ) Notice: Subject to any disclaimer, the term of this patent is extended or adjusted under 35 U.S.C. 154(b) by 0 days.

(21) Appl. No.: 09/239,567

(22) Filed: Jan. 29, 1999

(51) Int. Cl.[7] ..... G08B 1/00

(52) U.S. Cl. ..... 340/531; 340/506; 340/511; 340/517; 340/521; 340/524; 340/525; 340/531; 340/533; 340/825.06; 340/825.36; 340/825.49

(58) Field of Search ..... 340/506, 511, 340/517, 521, 524, 525, 531, 533, 825.06, 825.36, 825.49

(56) References Cited

U.S. PATENT DOCUMENTS 4,818,970 A * 4/1989 Natale et al. ..... 340/539

OTHER PUBLICATIONS

Article entitled "Improved Radiological Controls" by Dick Warnock, in *Radiation Protection Management*, May/Jun. 1997.

Article entitled "San Onofre Gets Wired for Refueling" by Sherry C. Folsom, in *Nuclear News*, Jun. 1997.

* cited by examiner

*Primary Examiner*—Daryl Pope
(74) *Attorney, Agent, or Firm*—Sheldon & Mak; Denton L. Anderson

(57) ABSTRACT

An apparatus combination useful in carrying out work within hazardous environments, especially radioactive environments. The combination includes (a) a plurality of portable input modules, each portable input module being capable of receiving video, audio and radiation dosimetry communications data and transmitting that data via a single portable input module data transmission cable, (b) a relay module for receiving the communications data from the plurality of portable input modules via each of the single portable input module's data transmission cables and for transmitting that data via a single relay module data transmission cable, and (c) a communications output station for receiving the communications data from the relay module via the single relay module data transmission cable and for translating that data into user recognizable video, audio and radiation dosimeter data output forms. Use of the invention has been found to markedly reduce the costs associated with set-up, testing, operation and disassembly of data and communications receiving equipment necessary within hazardous work areas. Moreover, use of the invention has been found to markedly increase the ability of the work coordinator to conduct work within a hazardous area in a safe and efficient manner.

20 Claims, 3 Drawing Sheets

PROTECTIVE SYSTEM FOR WORK IN RADIOACTIVE ENVIRONMENTS

FIELD OF THE INVENTION

This invention relates generally to methods and apparatus for working in hazardous environments and, more specifically, to methods and apparatus for working in radioactive environments.

BACKGROUND OF THE INVENTION

Since the earliest days of the Industrial Revolution, industry has struggled to safely conduct plant maintenance and other necessary work within hazardous environments. Prior to the second half of this century, most such hazardous environments involved hazardous chemical agents. Since 1950, such hazardous environments may also involve radioactive agents. Industry is continuously working towards improving equipment and techniques which will make working within such hazardous environments safer.

The nuclear power industry has been especially active in this regard. The problem faced by the nuclear power industry is how to safely conduct maintenance and other necessary work within the large confined structures wherein potential sources of radioactivity are typically housed. Work within such confining structures requires extensive efforts to minimize dangers to workers from radioactive exposure. In the 1990's, such efforts include the employment of a wide variety of sophisticated equipment to monitor radiation levels within the work area and to monitor the personal radiation exposure of each worker within the work area. Video cameras and radio communication equipment are also increasingly used to allow supervisory personnel outside the confining structure to more efficiently monitor and supervise work within the work area.

The use of such sophisticated equipment, however, has led to a number of problems. First of all, the use of the wide variety of sophisticated equipment frequently results in the work area being cluttered with an inordinate number of individual pieces of equipment. This not only presents a physical space problem, but also makes the work area prone to tripping accidents.

A second problem arises from the fact that each individual piece of equipment generally requires its own electrical power and generally requires its own data input and data output cables. This leads to a proliferation of electrical wires and cables strung throughout the work area. All of these electrical wires represent safety obstructions within the work area and make set-up of the various pieces of equipment inordinately complicated, time-consuming and expensive.

A third problem regarding the use of such sophisticated equipment arises from the fact that typical confining structures have a limited number of electrical outlets. The increasing use of individual sophisticated devices has created a competition for those electrical outlets, not only among the various pieces of equipment, but also between the various pieces of equipment and the electrical tools used by the workers performing the work. It is not unusual, for example, for a worker needing electrical power for his tool to unplug one of the sophisticated monitoring devices within the work area so as to have access to the electrical outlet for his tool.

A fourth problem regarding the use of the wide variety of sophisticated equipment arises from the difficulty in transmitting all of the data from each individual piece of equipment to monitoring stations located outside of the confining structure. Typically, such confining structures have only a very limited number of "penetration ports" through which electrical wires and cables can be run between the inside and the outside of the confining structure. As the number of sophisticated pieces of equipment within the work area has proliferated, the difficulty in transmitting all of the data from all of these pieces of equipment to outside the confining area has increased.

Accordingly, there is a need for improved techniques and equipment for maintaining the safety of workers within a confined hazardous area which avoid the above-described problems in the prior art—in an efficient and inexpensive manner.

SUMMARY

The invention satisfies this need. The invention is a combination comprising: (a) a plurality of portable input modules, each portable input module being capable of receiving video, audio and hazardous material indications data and transmitting that data via a single portable input module data transmission cable, (b) a relay module for receiving the communications data from the plurality of portable input modules via each of the single portable input module's data transmission cables and for transmitting that data via a single relay module data transmission cable, and (c) a communications output station for receiving the communications data from the relay module via the single relay module data transmission cable and for translating that data into user recognizable video, audio and hazardous material indications data output forms.

The invention provides a fully integrated module which allows for audio communications to be exchanged between several workers working simultaneously within the work area and for communications of audio, video and hazardous material indications data with health physics technicians and supervisors working away from the work area. The invention allows for the rapid and efficient set-up, operation and disassembly of various modular communications and hazardous material indications data receiver/transmitters. Use of the invention has been found to greatly reduce the costs of conducting work within hazardous environments, while greatly improving the ability of the workers to conduct the work in a safe and efficient manner.

The invention is ideally suited for use in a unique system for protecting workers within radioactive environments as set forth in U.S. patent application Ser. No. 09/240,917 now U.S. Pat. No. 6,282,410, entitled "Module Pack for Coordination of Work Within Hazardous Environments," filed concurrently herewith. The invention is also ideally suited for use with a unique head gear combination as set forth in U.S. patent application Ser. No. 09/239,228 now U.S. Pat. No. 6,035,450, entitled "Head Gear for Work in Radioactive Environments," filed concurrently herewith. The invention is still further ideally suited for use with a unique vest combination as set forth in U.S. patent application Ser. No. 09/239,557 now U.S. Pat. No. 6,260,202, entitled "Best for Work in Radioactive Environments," also filed concurrently herewith. The entirety of each of these three patent applications is incorporated herein by this reference.

DRAWINGS

These features, aspects and advantages of the present invention will become better understood with regard to the following description, appended claims and accompanying figures where:

DETAILED DESCRIPTION

Figure 1:
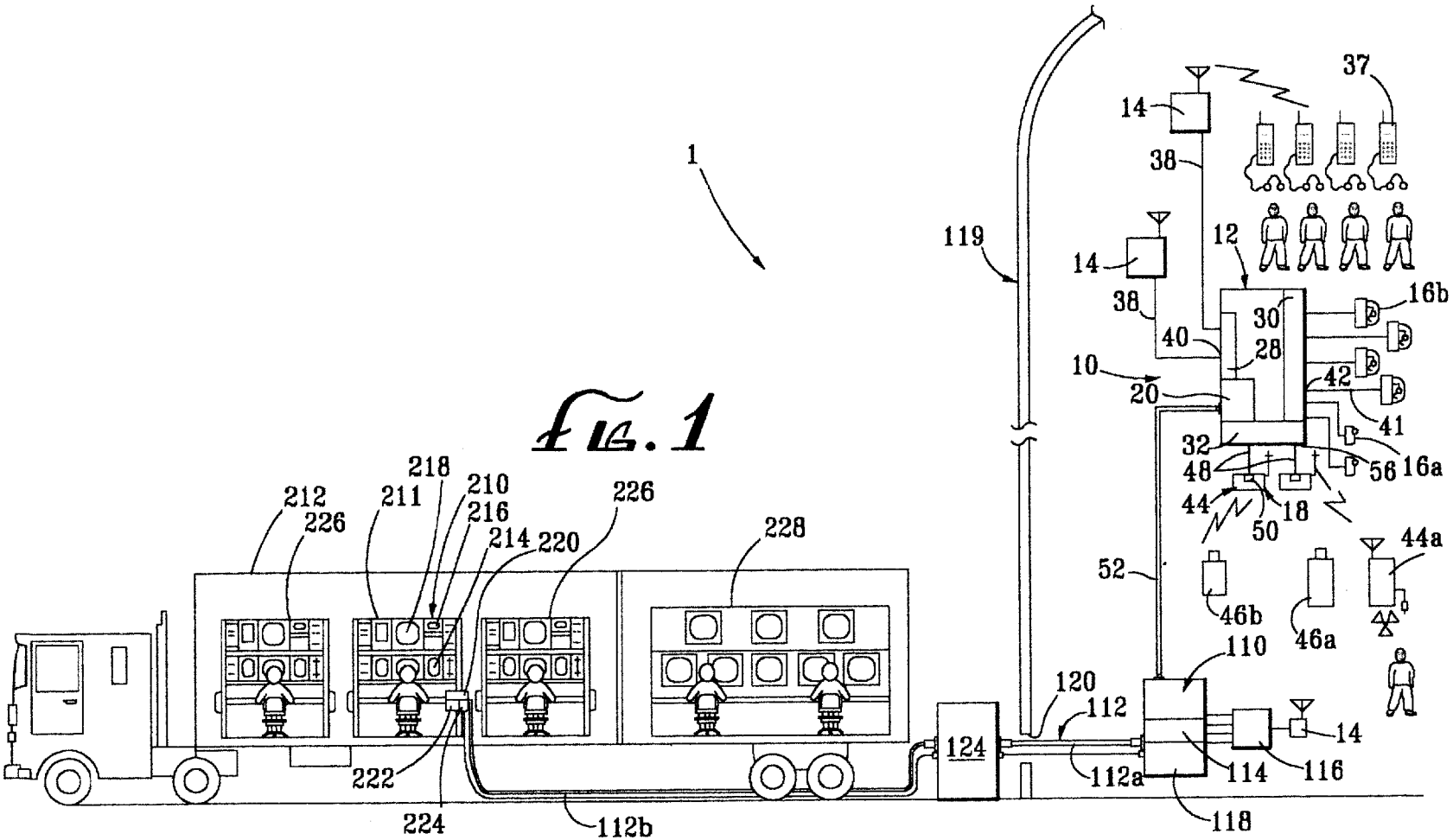
FIG. 1 is a diagrammatic view of a combination of apparatus having features of the invention.

The following discussion describes in detail one embodiment of the invention and several variations of that embodiment. This discussion should not be construed, however, as limiting the invention to those particular embodiments. Practitioners skilled in the art will recognize numerous other embodiments as well.

The invention is a combination 1 comprising a plurality of portable input modules 10, at least one relay module 110 and at least one communications output station 210.

The portable input modules 10 are each preferably identical to one another for ease of operation and maintenance. Each portable input module 10 is capable of receiving and transmitting video, audio and radiation dosimetry communications data between each input module 10 and the relay module 110 using a single input module data transmission cable 52.

Each input module 10 comprises a portable housing 12, an audio signal receiver 14, a video signal receiver 16, a hazardous material indications data receiver 18 and a communications data transmitter 20.

The portable housing 12 is a structure which provides a base location for the audio signal receiver 14, the video signal receiver 16, the hazardous material indications data receiver 18 and the communications data transmitter 20. The portable housing 12 can also be constructed to provide storage compartments for the various pieces of ancillary equipment when the input module 10 is not in use.

The housing 12 should be as compact as possible for convenient storage and maximum portability. For convenience in storage, the portable housing 12 can be parallelepiped in shape and enclose a volume less than about 12 cubic feet. In one embodiment, the portable housing 12 is parallelepiped in shape, and has the dimensions of 30"×30"×19".

Figure 2:
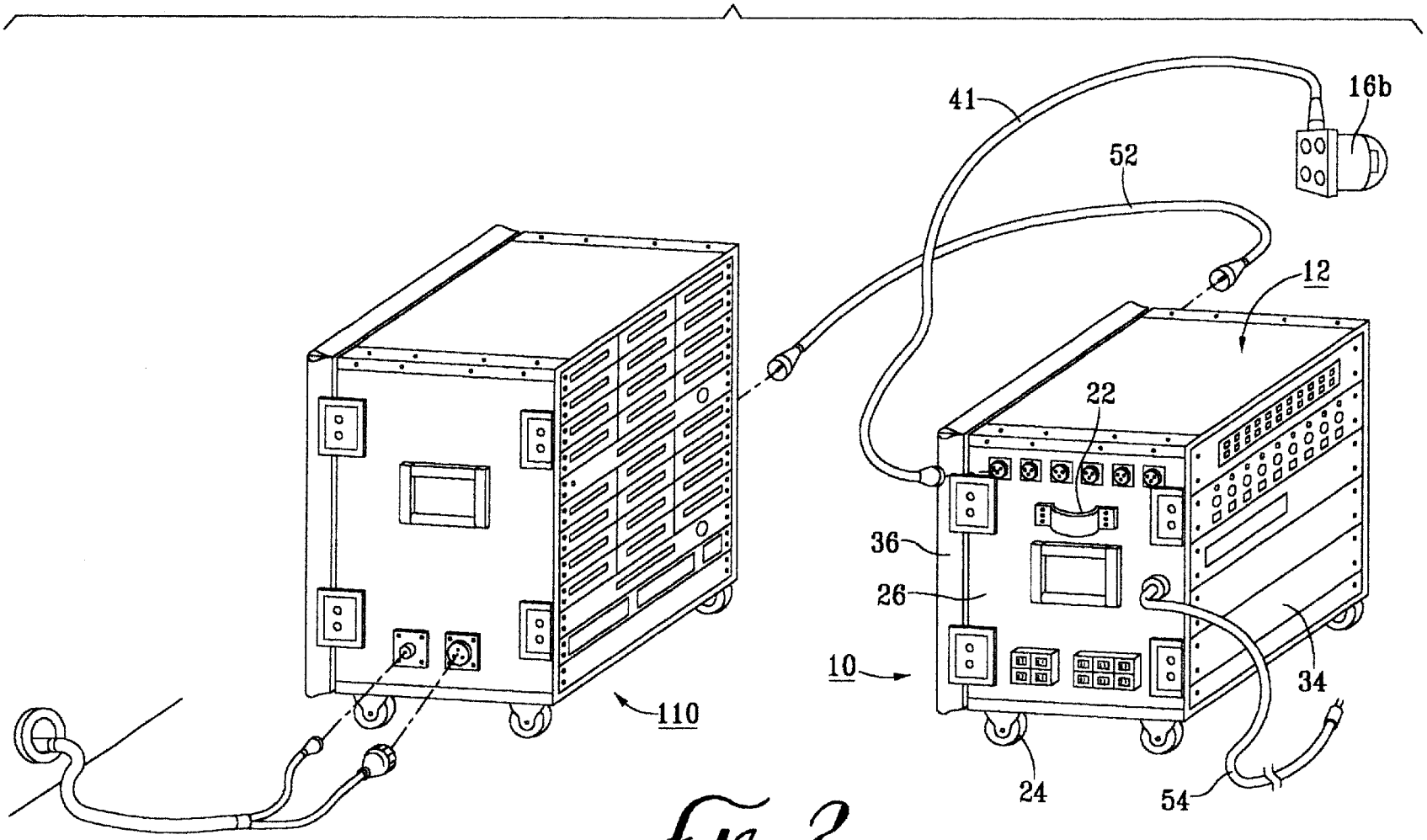
FIG. 2 is a perspective view of a pair of modules useful in the invention.

The portable housing 12 can further comprise a handle 12 and/or a plurality of wheels 24 to allow the housing to be easily translated across a horizontal surface. In the embodiment illustrated in FIG. 2, the portable housing 12 has four wheels 24, each disposed at one of the four lower-most corners of the portable housing 12.

Typically, each of the various cable connection ports required in the input module 10 (described below) are disposed on opposite ends 26 of the portable housing 12 for easy access. The internal parts of the input module 10 (such as the auto signal collections and retransmission device 28, the VTP transmitter 30 and the terminal server 32, described below) can be housed within the interior of the housing 12. Such internal parts are preferably made easily accessible for set-up, operation and maintenance via the opposed side walls 34 of the housing 12. Typically, the opposed side walls 34 are covered during storage by removable side doors 36.

The audio signal receiver 14 can be a radio signal receiver. Preferably, however, the audio signal receiver 14 comprises one or more microcell base stations 14 for receiving cellular phone signals from a plurality of cellular phones 37. Each microcell base station 14 is hardwired into the portable housing 12 by audio signal receiver cables 38 connected to audio signal receiver cable connection ports 40 disposed in the portable housing 12. Preferably, the audio signal receiver cable connection ports 40 are sized and dimensioned to attach only to audio signal connection cables 38.

It is also preferable that each microcell base station 14 be capable of handling a plurality of cellular phone users at one time. Each microcell base station 14 is of the "campus-wide" type, operating on low output power so as to not interfere with communications systems operating outside the containment structure 119. Typically, the microcell base stations 14 operate at less than about 1 watt, preferably at about 0.001 watts, and have an effective distance range of 150–1000 feet. Typical microcell base stations useable in the inventions are Model DCT900's manufactured by Ericsson Company of Sweden. Each such Model DCT900 base station operates at 0.001 watts and 900 megahertz, and is capable of supporting up to 8 digital PCS cellular phones at a distance of up to about 300 feet.

Preferably, the input module 10 further comprises a cable tester (not shown) disposed within the portable housing 12. The cable tester allows for set-up personnel to quickly and efficiently check for continuity of the audio signal input cables 38 and the polarity of the audio signal receiving system as a whole. Most preferably, the cable tester is designed and installed so that it can be plugged into each microcell base station 14 at the juncture where the audio signal input cable 38 is attached, so as to confirm the proper installation of the microcell base station 14 and to confirm the availability of the proper voltage.

The video signal receivers 16 typically are standard video cameras 16 which are hardwired to the portable housing 12 by video signal receiver cables 41 which connect to video signal receiver cable connection ports 42 disposed within the portable housing 12. Preferably, the video signal receiver cable connection ports 42 are sized and dimensioned to attach only to video signal receiver cables 41.

Preferably, the video signal receivers 16 comprise fixed video cameras **16*a* and video cameras of the pan/tilt/zoom variety 16*b*. The fixed cameras 16 can be any suitable fixed video camera. Panasonic Model F2 having a fixed focus and ¼" cod ("charge coupled device") have been found useable in the invention. Typical pan/tilt/zoom cameras 16*b*** useable in the invention are Model EC8 cameras manufactured by Elbex America, Inc. of Westminster, Calif. These cameras are dome-type cameras having 12× zoom, high resolution and ½" ccd.

In a typical embodiment, the input module 10 can receive input from up to six different video signal receivers 16.

The hazardous material indications data receiver 18 can be any receiver designed and adapted to receive a specific indications of the presence of a hazardous material. In hazardous chemical environments, for instance, the hazardous material indications data receivers 18 are designed and adapted to indicate the presence of one or more specific hazardous chemicals. When the invention 1 is used to monitor a radiation hazardous area, the hazardous material indications data receivers 18 are radiation dosimeter data receivers 18, as indicated in the embodiment illustrated in the drawings.

The radiation dosimeter data receivers 18 preferably comprise one or more electromagnetic wave receiving modems 44 which receive data transmitted by a plurality of electromagnetic wave transmitting devices ("teledosimeters") 46. Each such electromagnetic wave receiving modem 44 provides a "dosimeter base station" for support of multiple teledosimeters 46. The teledosimeters can include personal teledosimeters 46 attached to workers within a radiation hazardous area, fixed teledosimeters 46*b* useable in measuring radiation within a particular localized area ("area monitors") and air monitoring teledosimeters 46*c* capable of measuring the radioactivity of particles suspended within the atmosphere within a localized area. Preferably, each such teledosimeter 46 transmits radiation dosimetry data via radiowaves (or other electromagnetic waves) to the modems 44. Transmitting the dosimetry communications data via electromagnetic waves minimizes the number of electrical wires which must be strung out into the work area from the input module 10. Preferably, each modem 44 has multiple channels.

Typically, the modems 44 are of a number of any suitable radio wave receiving modems known in the industry. One such modem 44 useable in the invention is a Prolinx model modem manufactured by Proxim of Mountainview, Calif., capable of seven frequency channels.

In a typical embodiment, the input module 10 comprises sufficient modems 44 to support 16 workers.

Each modem 44 is typically hardwired into the input module by radiation dosimeter data input cables 48 connected to radiation dosimeter data input connection ports 50 which preferably accept only radiation dosimeter data input cables 48.

Preferably, the modems 44 are of a "heavy duty" variety capable of transmitting dosimetry communications data via an RJ45 connector, rather than the standard DB9 connector, and powered by 12 volt AC electrical supply, rather than by the more standard 9 volt DC electrical supply. In the invention, standard modems 44 having a DB9 connector and a 9 volt DC power input can be upgraded to "heavy duty" variety by use of an adaptor module 50 which allows connection to the modem 44 via an RJ45 connector and which allows the modem 44 to be powered by 12 volt AC electrical power (which is rectified and transformed in the adaptor module 50 to 9 volt DC electrical power).

Figure 4:
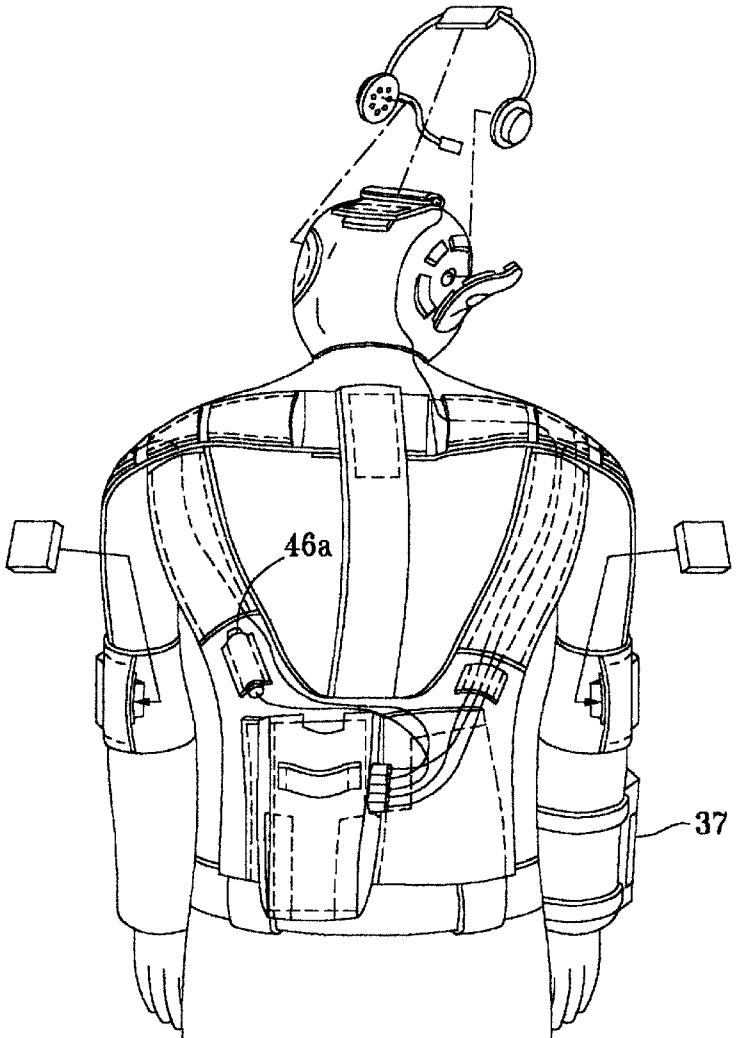
FIG. 4 is a perspective rear view of a radiation area workman carrying dosimeter equipment useful with the invention.
Figure 3:
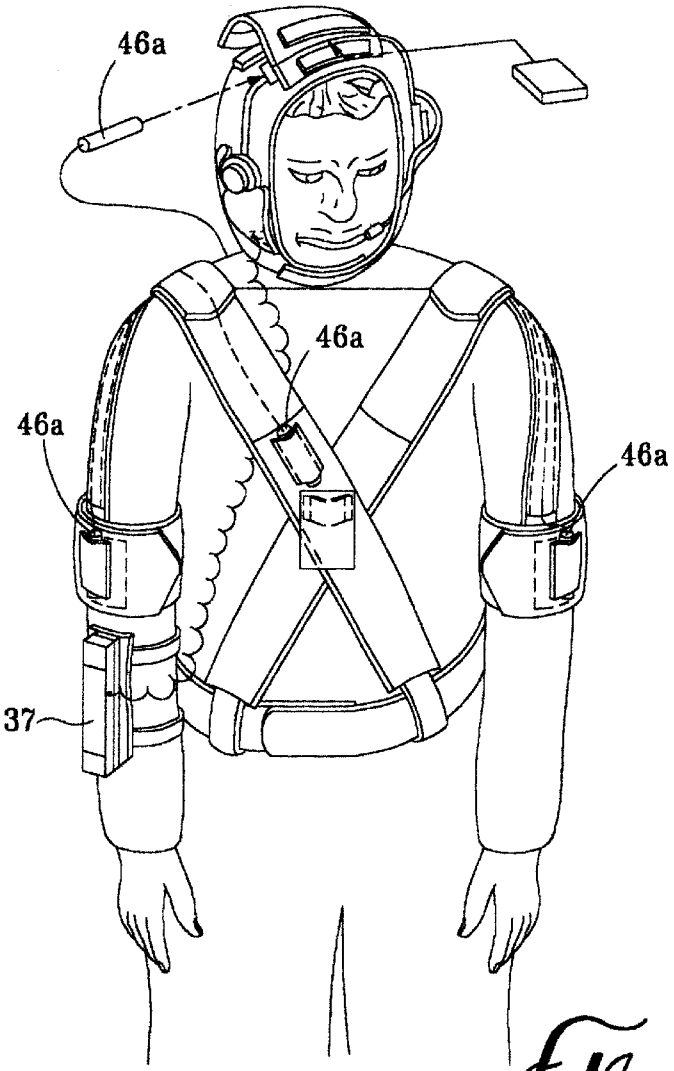
FIG. 3 is a perspective front view of a radiation area workman carrying dosimeter equipment useful with the invention.

Personal dosimetry data can be received from each of a plurality of personal teledosimeters 46*a* attached to the clothing of a worker working within the hazardous area, such as is illustrated in FIGS. 3–4. Typical personal teledosimeters 46*a* useable in the invention are manufactured by SIAC of San Diego, Calif.

Typical air monitors 46*c* useable in the invention are manufactured by Eberline of Sante Fe, N.M., and are sold as Models AMS4.

In a typical embodiment, the input module 10 can receive input from up to four dosimeter radiation data receiving modems 44.

Each of the audio signal receiver cables 38, video signal receiver cables 40 and radiation dosimetry data cables 48 are preferably category 5 or similar so that electric power for each of the audio, video and radiation dosimetry signal receivers 14, 16 and 18 are provided from the input modules via these cables 38, 40 and 48.

The communications data transmitter 20 is most conveniently typically disposed within the portable housing 10. The communications data transmitter 20 typically comprises the terminal server 32 which allows all of the dosimetry communications data received from the plurality of modems 44 to be multiplexed and transmitted to the relay module 110 via the single input module data transmission cable 52.

The housing 12 further comprises the audio data collections and retransmission device 28 such as a microcell manufactured by Ericsson of Sweden.

The communications data transmitter 20 also typically comprises a plurality of VIT transmitters 30 capable of accepting video communications data from each of the cameras 16 and transmitting that data to the relay module 110.

The single input module data transmission cable 52 can be any suitable cable capable of transmitting data from each input module 10 to the relay module 10. Use of a single cable minimizes the number of cables strewn across the floor of the work area and simplifies set-up of the equipment. In a typical embodiment, each input module data transmission cable 52 is an unshielded twisted pair ("UTP") cable.

Electrical energy for operating the various items of equipment associated with the input module 10 is provided by a single power cord 54, sized and dimensioned to conveniently be received into an electrical power outlet located within the work area.

The relay module 110 is capable of receiving the video, audio and hazardous material indications data from a plurality of the input modules 10 via the individual input module data transmission cables 52 and transmitting that data via a single relay module data transmission cable 112 to the communications output station 210.

The relay module 110 should be as compact as possible for convenient storage and maximum portability. For convenience in storage, the relay module 110 can be parallelepiped in shape and enclose a volume less than about 12 cubic feet. In one embodiment, the relay module 110 is parallelepiped in shape, and has the dimensions of 30"×30"×24".

Typically, the relay module 110 comprises an ethernet hub 114 to multiplex data received from the several input modules 10 and to transmit that data via the single relay module data transmission cable 112.

In the embodiment illustrated in the drawings, the relay module 110 further comprises a cellular phone radio exchange unit 116 capable of receiving and transmitting audio communications data between the microcell base stations 14 and the communications output station 210. The cellular phone radio exchange unit 116 can also include one or more microcell base stations 14 for directly receiving and transmitting audio cellular phone communication signals.

The relay module 110 typically further comprises an ethernet twisted pair receiver 118 to facilitate transmittal of communication signals and data to the communications output station 210 when the communications output station 210 is remote from the relay module 110.

Also in the embodiment illustrated in the drawings, each relay module transmission cable 112 passes from the interior of the containment structure 119 via a single penetration port 120. In the embodiment illustrated in FIG. 1, the relay module data transmission cable 112 comprises a first moiety 112*a* and a second moiety 112*b*. The first moiety 112*a* runs between the relay module 110 and an intermediate junction box 124 typically located in close proximation to the exterior of the containment structure 119. The second moiety 112*b* runs between the intermediate junction box 124 and the communications output station. The use of an intermediate junction box allows for the convenient replacement of the second moiety 112*b* of the module data transmission cable 112 in the event that it is damaged, for example, by equipment running over it. Because of the use of the intermediate junction box 124, repair or replacement of the second moiety 112*b* of the relay module data transmission cable 112 does not entail disturbing the first moiety 112*a* of the relay module transmission cable 112 (the portion of the relay module transmission cable 112 which passes through the penetration port 120 of the containment structure 119).

The communications output station 210 can be a fixed location, such as a control room. In the embodiment illustrated in FIG. 1, the communications output station is a portable unit mounted within a truck trailer 212.

The communications output station 210 includes at least primary location 211 where video, audio and radiation dosimetry communications data is received and conveniently displayed in output form. In a typical embodiment, video communications data is displayed on a plurality of video monitors 214 while audio communications data is received via conventional audio speakers 216 and/or head sets. Radiation dosimetry data is typically displayed on a single large computer monitor 218.

The communications output station 210 typically comprises an ethernet hub 220, UTP receivers 222 and battery back-up packs 224. The communications output station can further comprise one or more data switches (not shown) to allow the transmission of data to parallel receiving and display stations. In the embodiment illustrated in FIG. 1, the communications output station 210 comprises a primary output station 211 and a pair of secondary output stations 226. The embodiment further comprises an observation output station 228 suitable for use by plant operations and maintenance supervisory personnel.

In operation for work within a radiation hazardous work environment, the user of the input module 10 of the invention 1 transports each input module 10 into a hazardous area where workers will be performing work. In those embodiments where the portable housing 10 is equipped with wheels 24, the input module 10 can be conveniently pulled along the floor of the work area.

Once in the work area, the removable doors 36 on the opposite sides 34 of the portable housing 12 are removed, any equipment stored within the housing 12 is removed from the housing 12 for set-up and the internal parts disposed within the housing 12 are made operable.

Each of the microcell base stations 14 are connected via the audio signal receiver cables 38 to the audio signal receiver cable connection ports 40 located on the exterior of the portable housing 12. In devices having a cable tester, each of the microcell base stations 14 and requisite cable connections are tested for proper set-up.

Each of the video cameras 16 is connected to the VIT transmitter 30 by connecting the video data input cables 41 to the video data input cable connection ports 42, and each of the dosimeter radiation data receivers 18 is attached to the terminal server 32 by attaching the dosimeter radiation input cables 48 to the dosimeter radiation input cable connection ports 50.

In the preferred embodiments, set-up of the three primary classes of equipment (audio, video and dosimetry) is simple, easy and virtually "full-proof" because each of the connecting cables are sized and dimensioned so that only the correct cables can be connected to their respective connection ports. The cables and/or the connection ports can also be color-coded.

Thereafter, the electrical power cord 54 associated with each input module 10 can be connected to a suitable electrical power outlet located within the work area.

The input module data transmittal cable 52 is connected between the input module 10 and the relay module 110.

The relay module 110 is also located within the hazardous area. Each input module data transmittal cable 52 from each of the input modules 10 is properly connected to the relay module 110. Finally, the first moieties 112*b* relay module data transmission cable 112 is properly installed into the relay module 110 and strung through a penetration opening 120 to an intermediate junction box 124 located outside the hazardous area.

From the intermediate junction box 124, the second moiety 112*b* of the relay module data transmission cable 112 is connected to the suitable communications output station 210.

After set-up of typical equipment of the invention, as many as 32 workers per each input module 10 can be efficiently and safely maintained within the hazardous area. Audio, video and radiation dosimetry communications data is continually transmitted from each worker through an input module 10, through the relay module 10 and to the communications output station 210 where it can be continuously monitored in real time by health physics technicians, by plant operating supervisors and by maintenance supervisors. Health physics technicians, plant operating supervisors and maintenance supervisors can communicate with the workers and the workers can communicate among themselves via the audio transmission equipment of the invention described herein.

Moreover, through the course of the work, plant operating supervisors and maintenance supervisors can view the progress of the work and any specific problems which arise in the work via the video equipment of the invention described herein.

Finally, throughout the course of the work, health physics technicians can monitor the individual radiation exposure of each worker, the radiation intensity within the various areas of the work place and the radiation intensity of the air within various locations within the work place. Using this information, the health physics technicians can continuously coordinate each of the workers to minimize his or her radiation exposure. The health physics technicians can also use this information to recognize changes in the hazardous conditions existing within the work area, and to take appropriate remedial actions.

It should be appreciated by those skilled in this technology that the equipment of the invention can be assembled conveniently, quickly and with minimum error. Once assembled, the equipment provides critical data and communications input from the work area with a minimum of cabling strewn about the work area.

When work within the work area is complete, the equipment and its various associated data and communications receiving devices and cables can also be conveniently and quickly disassembled and removed from the work area for storage.

Use of the invention has been found to markedly reduce the costs associated with set-up, testing, operation and disassembly of data and communications receiving equipment necessary within hazardous work areas. Moreover, use of the invention has been found to markedly increase the ability of the work coordinator to conduct work within a hazardous area in a safe and efficient manner.

Use of the invention is also believed to be of great utility to hazardous materials, fire and other emergency response personnel who must deal with an emergency within a hazardous area. Such emergency response personnel can quickly, simply and effectively set up and operate communications and/or hazardous material indications data transmitting equipment so that emergency personnel can safely deal with an emergency within the hazardous area.

Having thus described the invention, it should be apparent that numerous structural modifications and adaptations may be resorted to without departing from the scope and fair meaning of the instant invention as set forth hereinabove and as described hereinbelow by the claims. In this regard, any element in a claim that does not explicitly state "means" for performing a specified function, or "step" for performing a specified function should not be interpreted as a "means" or a "step" clause as specified in 35 U.S.C. §112.

What is claimed is:

1. A combination comprising:

(a) a plurality of portable input modules, each portable input module being capable of receiving video, audio and radiation dosimetry communications data and transmitting that data via a single portable input module data transmission cable;

(b) a relay module for receiving the communications data from the plurality of portable input modules via each of the single portable input module's data transmission cables and for transmitting that data via a single relay module data transmission cable; and (c) a communications output station for receiving the communications data from the relay module via the single relay module data transmission cable and for translating that data into user recognizable video, audio and radiation dosimeter data output forms.

2. The combination of claim 1 wherein the communications output station comprises video display monitors.

3. The combination of claim 1 wherein the communications output station comprises one or more computer monitors for displaying real time radiation dosimeter data received from the input modules.

4. The combination of claim 1 comprising a plurality of communications output stations.

5. A combination comprising:

(a) a plurality of portable input modules, each portable input module being capable of receiving video, audio and radiation dosimetry communications data and transmitting that data via a single portable input module data transmission cable;

(b) a relay module for receiving the communications data from the plurality of portable input modules via each of the single portable input module's data transmission cables and for transmitting that data via a single relay module data transmission cable; and (c) a communications output station for receiving the communications data from the relay module via the single relay module data transmission cable and for translating that data into user recognizable video, audio and radiation dosimeter data output forms;

wherein the portable input modules are electrically powered; and wherein the electrical energy for powering each portable input module is transmitted to each portable input module via a single portable input module power cord running from each portable input module to the relay module and via a single trunk line power cord running from the relay module to a source of electrical energy.

6. A combination comprising:

(i) a plurality of portable input modules, each portable input module being capable of receiving video, audio and radiation dosimetry communications data and transmitting that data via a single portable input module data transmission cable;

(ii) a relay module for receiving the communications data from the plurality of portable input modules via each of the single portable input module's data transmission cables and for transmitting that data via a single relay module data transmission cable; and (iii) a communications output station for receiving the communications data from the relay module via the single relay module data transmission cable and for translating that data into user recognizable video, audio and radiation dosimeter data output forms wherein each input module comprises:

(a) a portable housing;

(b) an audio signal receiver attached to the housing, the audio signal receiver being capable of receiving electromagnetic audio signals;

(c) a video signal receiver attached to the housing, the video signal receiver being capable of receiving video signals;

(d) a radiation dosimeter receiver attached to the housing, the radiation dosimeter receiver being capable of receiving radiation dosimeter data; and (e) a communications data transmitter for transmitting the audio signals, the video signals and the radiation dosimeter data to a location separate from the housing via a single communications data transmission cable.

7. The combination of claim 6 wherein the housing encloses a volume less than about 12 cubic feet.

8. The combination of claim 6 wherein the audio signal receiver is a plurality of microcell base stations, each capable of supporting multiple cellular telephones.

9. The combination of claim 6 having a plurality of video signal receivers.

10. The combination of claim 9 wherein the video signal receivers further comprise at least one video camera control signal transmitter capable of transmitting control signals to a pan/tilt/zoom video camera.

11. The combination of claim 6 comprising a plurality of radiation dosimeter receivers, each capable of receiving radiation dosimeter data via electromagnetic waves.

12. The combination of claim 6 wherein the communications data transmission cable is a UTP cable.

13. A combination comprising:

(a) a plurality of portable input modules, each portable input module being capable of receiving video, audio and radiation dosimetry communications data and transmitting that data via a single portable input module data transmission cable;

(b) a relay module for receiving the communications data from the plurality of portable input modules via each of the single portable input module's data transmission cables and for transmitting that data via a single relay module data transmission cable; and (c) a communications output station for receiving the communications data from the relay module via the single relay module data transmission cable and for translating that data into user recognizable video; audio and radiation dosimeter data output forms;

wherein the relay module further comprises a cellular telephone/radio exchange unit capable of receiving and transmitting audio communications data between each input module and the communications output station.

14. A combination comprising:

(a) a plurality of portable input modules, each portable input module being capable of receiving video, audio and radiation dosimetry communications data and transmitting that data via a single portable input module data transmission cable;

(b) a relay module for receiving the communications data from the plurality of portable input modules via each of the single portable input module's data transmission cables and for transmitting that data via a single relay module data transmission cable; and (c) a communications output station for receiving the communications data from the relay module via the single relay module data transmission cable and for translating that data into user recognizable video; audio and radiation dosimeter data output forms;

wherein the communications output station comprises audio receiving and transmission equipment capable of enabling a user located in the communications output station to communicate with individuals via the input modules.

15. A combination comprising:

(a) a plurality of portable input modules, each portable input module being capable of receiving video, audio and hazardous material indications data and transmitting that data via a single portable input module data transmission cable;

(b) a relay module for receiving the communications data from the plurality of portable input modules via each of the single portable input module's data transmission cables and for transmitting that data via a single relay module data transmission cable; and (c) a communications output station for receiving the communications data from the relay module via the single relay module data transmission cable and for translating that data into user recognizable video, audio and hazardous material indications data output forms.

16. A combination comprising:

(i) a plurality of portable input modules, each portable input module being capable of receiving video, audio and radiation dosimetry communications data and transmitting that data via a single portable input module data transmission cable;

(ii) a relay module for receiving the communications data from the plurality of portable input modules via each of the single portable input module's data transmission cables and for transmitting that data via a single relay module data transmission cable; and (iii) a communications output station for receiving the communications data from the relay module via the single relay module data transmission cable and for translating that data into user recognizable video, audio and radiation dosimeter data output forms;

wherein each input module comprises:

(a) a portable housing;

(b) an audio signal receiver attached to the housing, the audio signal receiver being capable of receiving electromagnetic audio signals;

(c) a video signal receiver attached to the housing, the video signal receiver being capable of receiving video signals;

(d) a hazardous material indications receiver attached to the housing, the hazardous material indications receiver being capable of receiving hazardous material indications data; and (e) a communications data transmitter for transmitting the audio signals, the video signals and the hazardous material indications data to a location separate from the housing via a single communications data transmission cable.

17. The combination of claim 16 wherein the audio signal receiver is a plurality of microcell base stations, each capable of supporting multiple cellular telephones.

18. The combination of claim 16 wherein the communications output station comprises audio receiving and transmission equipment capable of enabling a user located in the communications output station to communicate with individuals via the input modules.

19. A combination comprising:

(a) a plurality of portable input modules, each portable input module being capable of receiving video, audio and hazardous material indications data and transmitting that data via a single portable input module data transmission cable;

(b) a relay module for receiving the communications data from the plurality of portable input modules via each of the single portable input module's data transmission cables and for transmitting that data via a single relay module data transmission cable; and (c) a communications output station for receiving the communications data from the relay module via the single relay module data transmission cable and for translating that data into user recognizable video, audio and hazardous material indications data output forms; and (d) a plurality of video signal receivers.

20. A combination comprising:

(a) a plurality of portable input modules, each portable input module being capable of receiving video, audio and hazardous material indications data and transmitting that data via a single portable input module data transmission cable;

(b) a relay module for receiving the communications data from the plurality of portable input modules via each of the single portable input module's data transmission cables and for transmitting that data via a single relay module data transmission cable; and (c) a communications output station for receiving the communications data from the relay module via the single relay module data transmission cable and for translating that data into user recognizable video, audio and hazardous material indications data output forms;

wherein the relay module further comprises a cellular telephone/radio exchange unit capable of receiving and transmitting audio communications data between each input module and the communications output station.

* * * * *